US005556092A

United States Patent [19]

Theken

[11] Patent Number: 5,556,092

[45] Date of Patent: Sep. 17, 1996

[54] ERGONOMIC HANDLE

[76] Inventor: Randall R. Theken, 1115 Robinson Ave., Barberton, Ohio 44203

[21] Appl. No.: 328,027

[22] Filed: Oct. 24, 1994

[51] Int. Cl.[6] ..... A63B 49/00; B25G 1/00

[52] U.S. Cl. ..... 273/75; 7/167; 16/110 R; 81/177.1; 81/489; 606/1

[58] Field of Search ..... 81/177.1, 489; 7/167, 168; 16/110 R, 121; 606/79, 167, 1; 273/73 R, 75

[56] References Cited

U.S. PATENT DOCUMENTS

D. 318,116 7/1991 Michelson .
D. 336,957 6/1993 Koros et al. .
2,382,304 8/1945 Foltz et al. .
3,592,247 7/1971 Solf ..... 81/177.1
3,886,943 6/1975 Skiff et al. ..... 606/167 X
4,828,261 5/1989 Kleylein ..... 273/75
5,251,380 10/1993 Craig .

FOREIGN PATENT DOCUMENTS 2307186 8/1974 Germany ..... 81/177.1

*Primary Examiner*—William H. Grieb
*Attorney, Agent, or Firm*—Hudak & Shunk Co., LPA

[57] ABSTRACT

A handle grip is provided which has undulating surfaces to provide a comfortable, non-slip interface with the user's hand, the handle having first and second concentric gripping ridges separated by gripping valleys from a thumb ridge and reach other, respectively. The valleys include a plurality of ovoid dimples to increase the surface of interface between the user's fingers and the handle.

12 Claims, 2 Drawing Sheets

ERGONOMIC HANDLE

FIELD OF INVENTION

The present invention relates to a handle which has an improved profile for the application of force to an object and which can be comfortably gripped using the fingers as well as the palm of the hand.

BACKGROUND

There are various applications of instruments and tools having a grip interface in which the user grasps the implement with the forefinger down and the side of the grip resting against the palm of the hand. Industrial hand tools such as screwdrivers and hammers, as well as racquets, represent examples of such tools.

For some applications, it is important to allow a user interface which maximizes the gripping potential for the user in order to allow the user to either absorb a force or apply a force to a separate object. For example, tennis racquets and racquetball racquets transmit a direct force when the ball hits the racquet surface. In applications such as screwdrivers, the user depends upon a grip interface in order to permit the user to transmit torque through the tool to an object.

The present invention relates to a handle grip which is ergonomically designed in order to optimize comfort to the user as the grip is held in various ways, and to allow a relatively slip-free tool interface.

SUMMARY OF THE INVENTION

The invention has the object of providing a comfortable handle grip for racquets and for tools which allows for the application of force in a comfortable way, and has a number of different holding options so that the implement can be used in different manners. Thus, the present invention has an object of providing a comfortable industrial tool or sports racquet handle as well as a comfortable surgical tool which is effectively used for applying torque as well as for prying and hammering.

The foregoing objects are achieved by providing a handle having a first gripping ridge and a second gripping ridge, a first annular thumb rest area, and a rounded butt end. The thumb rest area is separated from the first gripping ridge by a first valley area including flattened dimples. The first ridge is separated from the second ridge by a second valley area including similar flattened dimples and the second ridge is separated from the butt end of the handle by a sloped region including flattened dimples. The ridged areas undulate without sharp edges and allow the fingers to separate and grasp the grip so that each of the flanges meets a dimpled area and the joints of the flanges can cooperate with the ridged areas.

The grip of the present invention is particularly useful for consumer and industrial applications, for tool handles such as machine tool handles, screwdrivers, hammers and power hand-tools, as well as sport racquet handles. The handle is useful for home or industrial applications where the user is transmitting a force or a torque, and it enables the sports player to engage the racquet handle firmly and resist the rotation of the handle as the racquet hits the game ball or shuttlecock. Additionally, sports applications exist such as fishing poles and the like.

The grip of the present invention is also useful in a slightly smaller configuration as a tool handle, particularly for use on a dental or medical instrument. In many instances, such as in orthopedic surgery, the surgeon is required to apply torque to an appliance such as a screw or nut, or otherwise manipulate metallic inserts such as by applying pressure to cause a surgical implant to come into alignment. It is essential that a surgical instrument serve the intended purpose, while allowing the surgeon a comfortable fit in the hand so that the hand does not become cramped during long and tedious or delicate operations.

The present invention serves as a grip for a surgical instrument designed to permit a user to engage the instrument in a power position in which the distal ridge (i.e., second gripping ridge) fits into the palm of the hand with the first flange of the thumb in the first valley and the index and middle fingers wrapping around the second valley and around the lower distal ridge, and a circumferential portion of the butt end of the instrument contacting the heel of the hand. In a position used for more delicate turning manipulations, the butt end of the instrument is held against the palm of the hand with the thumb, index and middle fingers engaging the middle valley region of the grip. Alternatively, the instrument can be held with the little finger in the first valley and thumb and forefinger in the slope between the second ridge and the butt end of the instrument in order to allow leverage to be applied to the instrument.

DETAILED DESCRIPTION

Figure 1:
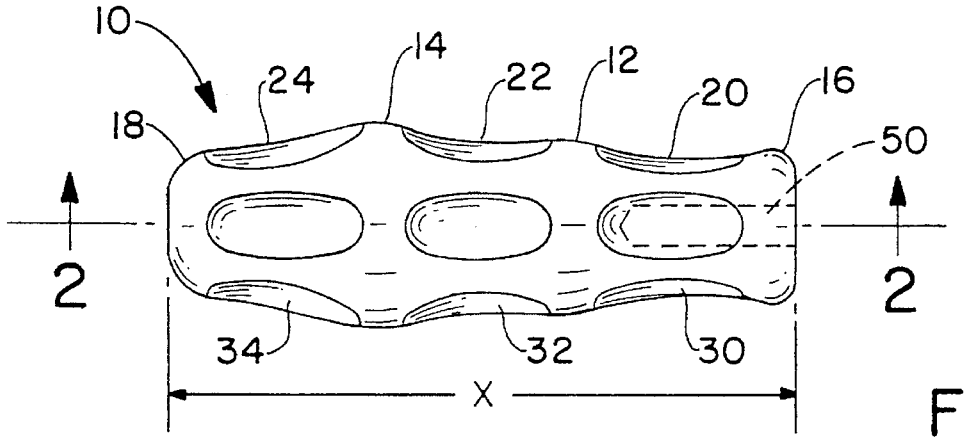
FIG. 1 shows a side view of the instrument in accordance with the invention.

FIG. 1 illustrates a handle grip 10 which is suitable for use as an industrial tool handle, sports racquet handle, or a medical instrument handle. The handle grip has a series of concentric ridged areas separated by gripping valleys. In particular, a first ridge 12 is located a portion of the way along the longitudinal length X of the handle. The first ridge is from about 0.2 to about 0.4 inch and preferably from about one-third of the distance X from the instrument end to the butt end of the handle.

A second concentric ridge 14 is generally larger in diameter than the first gripping ridge 12 and is located at from about 0.5 to about 0.75 times X, and preferably about two-thirds of the way from the instrument end to the butt end of the grip.

The grip 10 further includes a ridge or shoulder 16 at the instrument end of the grip which forms a thumb rest to restrain the user's hand from slipping longitudinally down the grip onto the instrument proper.

The grip 10 further includes a rounded butt end 18 which fits neatly into the cupped palm of a hand. The grip includes valleys which are dimpled to provide for a flat pressure area to maximize contact between the fleshy parts of the user's fingers and the handle grip. A first valley 20 is located between the thumb ridge 16 and the first concentric ridge 12, while a second valley 22 is located between the first gripping ridge 12 and the second gripping ridge 14. A sloping area 24 is located between the second concentric ridge 14 and the butt end 18 of the grip.

The valleys include oval or elliptically shaped dimples 30,32. The first set of dimples 30 are aligned with the long axis running in the direction of the long axis of the handle and there are generally from about 4 to about 8, most preferably about 6 dimples arranged around the circumference of the grip.

For use as an orthopedic handle, the measurements are as follows. The first set of dimples are oval-shaped with a maximum width ranging from about 0.3 to about 0.6 inch, and preferably about 0.48 inch. The second set of dimples are oval-shaped with a maximum width ranging from about 0.3 to about 0.6 inch, and preferably about 0.48 inch. The third set of dimples are oval-shaped with a maximum width ranging from about 0.4 to about 0.7 inch, and preferably about 0.58 inch. Generally, the sets of dimples decrease in size from the first set to the third set to accommodate the area of the hand which mates with the surface during use. The dimples are from about 0.75 inch to about 1.4 inches long along the longitudinal axis. The length may be uniform or may vary from the first to the third set. Further, the first set of dimples are at a depth of from about 0.04 to about 0.08 inch, and preferably about 0.06 inch from the outer circumference of the valleys. The second set are generally shallower than the first set and are at a depth of from about 0.02 to about 0.04 inch and preferably about 0.032 inch. The third set of dimples are at a depth of from about 0.04 to about 0.08 inch, and preferably about 0.06 inch.

The second valley 22 similarly has a set of four to eight and preferably six dimples 32, while the sloping area 24 preferably has a set of four to eight and preferably six concentric dimples 34.

Figure 3:
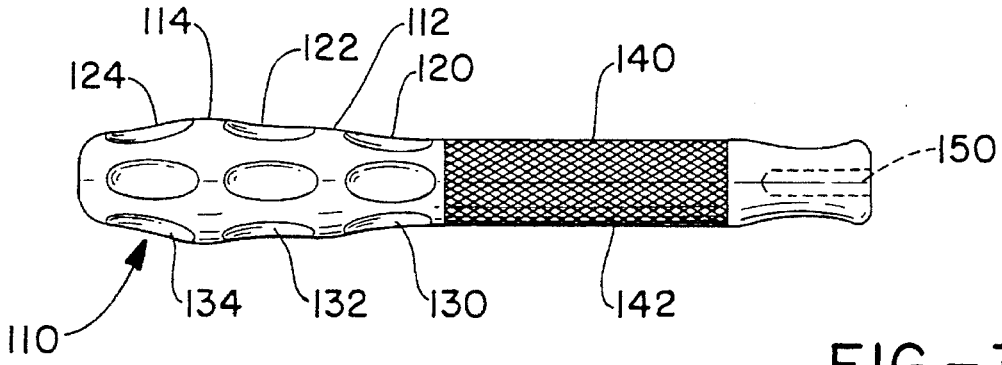
FIG. 3 shows a side view of a second embodiment of the handle in accordance with the invention.

Further, for use as a surgical instrument as shown in FIG. 1, the handle has a length of from about 4 to about 6 inches, and preferably about 5 inches. In a second embodiment, as shown in FIG. 3, the handle 110 can further comprise a leveraging shaft portion 140 of from about 4 to about 6 inches, and includes a high friction or knurled surface 142, with the concentric ridges 112, 114 having a longitudinal length of from about 0.2 to about 0.6 inch, and preferably about 0.4 inch. Further dimensions of the diameters of the grip for a surgical instrument are as follows. The thumb grip portion has a diameter of from about 0.9 inch to about 1.5 inches, preferably about 1.2 inches. The first valley, at the smallest diameter thereof, has a diameter of about 0.8 inch to about 1.3 inches, most preferably about 1.0 inch. The diameter of the first gripping ridge is from about 1.0 inch to about 1.6 inches, preferably about 1.3 inches. The diameter of the second valley is about 1.0 inch to about 1.6 inches, preferably about 1.3 inches, with a difference of about 0.05 inch from the first concentric ridge. The first ridge preferably has a difference of about 0.2 to about 0.4 inch and preferably about 0.3 inch increase in diameter from the first valley. The second concentric ridge has a diameter of from about 1.0 inch to about 1.8 inches, and most preferably about 1.5 inches. The sloping area has a diameter of about 1.0 inch to about 1.4 inches, and preferably about 1.15 inches. The butt end of the handle grip, at its widest point, has a diameter of about 1.1 to about 1.3 inches.

The handle is somewhat longer when used with a racquetball grip and has a length of from about 5.5 inches to about 6.5 inches, with other dimensions substantially corresponding to the medical handle previously discussed.

For industrial tool applications the handle size can be adjusted to provide either more or less torque depending on the application.

For use with industrial tools or for sport racquet handles as shown in FIG. 1, the relative dimensions will be the same as for the orthopedic tool except that the absolute size will be larger, smaller, or the same, according to the application. For example, machine lever handles could be significantly larger, while optical or computer hand tools could be quite delicate. Racquet handles are generally only slightly larger than the orthopedic tools. For these uses, the handle has a length of from about 1.0 inch to about 8.5 inches, with the concentric ridges having a longitudinal length of from about 0.4 inch to about 3.5 inches. Further dimensions of the diameters of the grip for an industrial instrument are as follows. The thumb grip portion has a diameter of from about 0.25 inch to about 2 inches. The first valley, at the smallest diameter thereof, has a diameter of about 0.3 inch to about 2.25 inches. The diameter of the first gripping ridge is from about 0.3 inch to about 2.4 inches. The diameter of the second valley is about 0.3 inch to about 2.25 inches. The second concentric ridge has a diameter of from about 0.3 inch to about 2.7 inches. The sloping area has a diameter of about 0.25 inch to about 2.1 inches. The butt end of the handle grip, at its widest point, has a diameter of about 0.25 inch to about 2.1 inches.

For the foregoing handles, the dimples will vary in size according to the overall dimensions, with the ovals having a maximum width of from about 0.1 to about 1.0 inch, a length of from about 0.25 inch to about 2 inches, and a depth of about 0.01 to about 0.13 inch.

For industrial and sports racquet handle applications, the optimal dimple measurements range from larger handles to smaller handles as compared to the orthopedic handle depending on the handle use. For some uses, the measurements are equivalent. For these applications, which encompass handles ranging widely in size, dimples are oval-shaped with a maximum width ranging from about 0.1 to about 1.0 inch. Generally, the sets of dimples decrease in size from the third set to the first set to accommodate the area of the hand which mates with the surface during use. The dimples are from about 0.75 inch to about 1.25 inches long along the longitudinal axis. The length may be uniform or may vary from the first to the third set. Further, the first set of dimples are at a depth of from about 0.015 to about 0.125 inch. The second set are at a depth of from about 0.005 to about 0.063 inch, and the third set of dimples are at a depth of from about 0.015 to about 0.125 inch.

FIG. 3 illustrates a second embodiment of the present invention having a handle grip area 110 corresponding generally to the grip shown in FIG. 1. The grip has a first concentric ridge 112 and a second concentric ridge 114, separated by a first gripping valley 122. The grip further includes a second gripping valley, and a sloping portion 124. The valleys and sloping area include generally oval dimples 130. The handle grip further includes an elongate leveraging portion 140 which preferably has a non-slip surface such as knurls 142. The handle has a central bore 150 to receive the distal end of an instrument (not shown).

Figure 4:
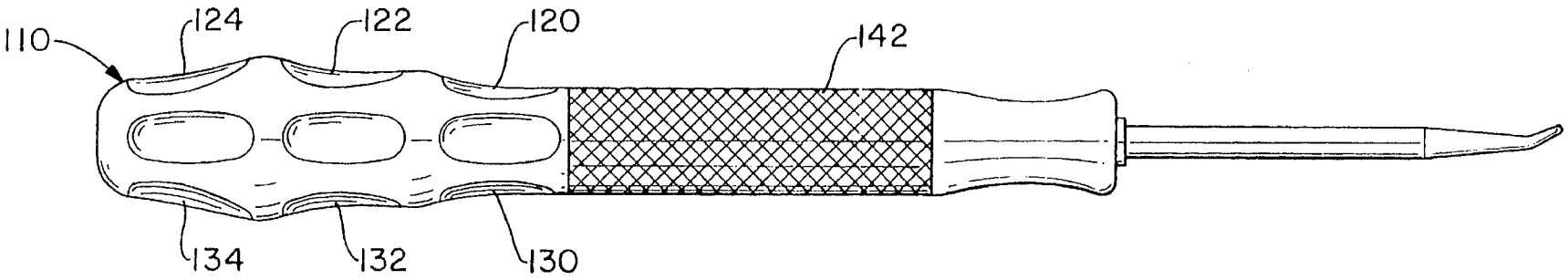
FIG. 4 shows a medical instrument including the handle of the invention.

The handle of the present invention is made of a suitable material depending on the particular application. For surgical applications, the handle should be lightweight, sterilizable, and have a good hand. Preferably, the handle has a Notched Izod of more than 10 pounds per inch as measured by ASTM test D256A. A suitable material is Raydel-R® polyphenylsulfone resin sold by Amoco. A suitable method of making an instrument handle is injection molding or machining the handle from bar stock. For other applications suitable materials include most commercially available plastics including, but not limited to nylons, polyvinyl chloride, polyolefins, polyurethanes, epoxides, polyesters, elastomers, and polystyrenes. In addition, suitable material could include metal and wood. FIG. 4 illustrates a medical instrument including a handle 110 similar to the embodiment shown in FIG. 3.

Figure 2:
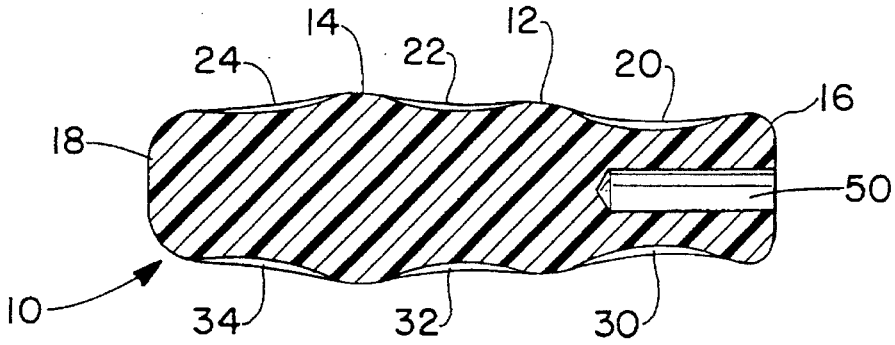
FIG. 2 shows a cross-section taken through line 2—2.
Figure 5:
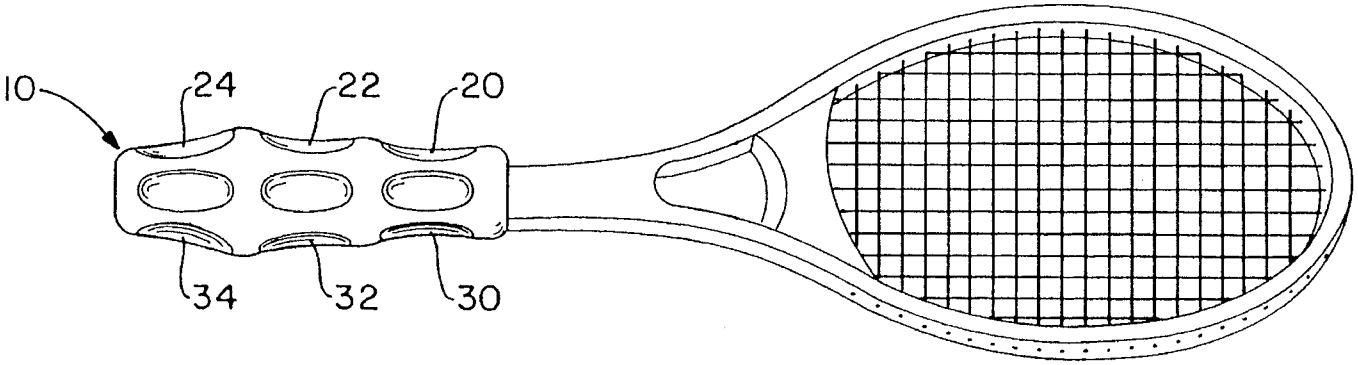
FIG. 5 show a sports racquet including the handle of the invention.

FIG. 5 illustrates a sports racquet including a handle similar to the embodiment shown in FIGS. 1 and 2.

While in accordance with the patent statutes the best mode and preferred embodiment has been set forth, the scope of the invention is not limited thereto, but rather by the scope of the attached claims.

What is claimed is:

1. A handle grip having a longitudinal axis, extending between an instrument end and a butt end, the grip comprising a first concentric gripping ridge, and a second concentric gripping ridge, the area between the instrument-end of the handle and the first concentric gripping ridge defining a first gripping valley, the area between the second concentric gripping ridge and the first concentric gripping ridge defining a second gripping valley, said first gripping valley and said second griping valley each including flattened grip areas which comprise ovals with the longitudinal axis in the direction of the longitudinal axis of the handle grip and wherein there are about 4 to about 8 ovals about the circumference of each valley, and the area between the butt-end of the instrument and the second gripping ridge defining a gripping sloped area, the diameter of the first gripping ridge exceeding the diameter of the first gripping valley, the diameter of the second gripping ridge exceeding the diameter of the first gripping ridge and the butt-end of the instrument forming a smooth, generally rounded profile.

2. A handle grip as set forth in claim 1, in which the first concentric gripping ridge is located at from about 0.2 to about 0.4 of the length X of the longitudinal axis of the handle, and the second gripping ridge is located at about 0.5 to about 0.75 of the length X along the longitudinal axis.

3. A handle grip as set forth in claim 1, wherein said first concentric ridge has a diameter of from about 0.75 inch to about 1.25 inches, said second valley has a diameter of about 1.0 inch to about 1.5 inches, and wherein said second gripping ridge has a diameter of from about 1.25 to about 1.75 inches.

4. A handle grip as set forth in claim 1, wherein said first concentric ridge has a diameter of from about 0.3 inch to about 2.4 inches, said second valley has a diameter of about 0.3 inch to about 2.3 inches, and wherein said second gripping ridge has a diameter of from about 0.3 inch to about 2.7 inches.

5. A handle grip as set forth in claim 1, further including a thumb grip area and the first concentric gripping valley having a diameter which is smaller than the diameter of first concentric ridge, and the first concentric gripping ridge having a diameter which is smaller than the diameter of the second concentric gripping ridge and the second concentric gripping valley having a diameter which is smaller than the diameter of the second concentric gripping ridge.

6. A handle grip for use with a medical instrument, the handle grip having a longitudinal length of about 4.0 to about 8.0 inches extending from an instrument end to a butt end, and having a circumferential surface defining a gripping surface, and comprising a thumb ridge having a diameter of about 0.8 inch to about 1.5 inches, a first concentric ridge having a diameter of from about 1.0 inch to about 1.5 inches, and a first gripping valley therebetween having a diameter of about 1.3 to about 1.5 inches; a second concentric ridge having a diameter of from about 1.2 to about 1.8 inches and a second valley between said second concentric ridge and said first concentric ridge, said second valley having a diameter from about 1.0 inch to about 1.5 inches; said first and second valleys including textured gripping surfaces; and a rounded butt end and such handle being substantially devoid of sharp edges on its gripping surface; and said handle grip being comprised of a sterilizable material having a Notched Izod value of at least 10 as measured by ASTM test D256A.

7. A handle grip as set forth in claim 6, wherein said grip is comprised of polyphenylsulfone.

8. A handle grip as set forth in claim 6, wherein the handle is part of an orthopedic tool.

9. A sports handle grip for an implement which is a tennis racquet, a racquetball racquet, a squash racquet, or a badminton racquet, having a longitudinal axis and a length X, extending between an implement end and a butt end, the grip comprising a first concentric gripping ridge and a second concentric gripping ridge, the area between the implement-end of the handle and the first concentric gripping ridge defining a first gripping valley, the area between the second concentric gripping ridge and the first concentric gripping ridge defining a second gripping valley, and the area between the butt-end of the implement and the second gripping ridge defining a gripping sloped area, the diameter of the first gripping ridge exceeding the diameter of the first griping valley, the diameter of the second gripping ridge exceeding the diameter of the first gripping ridge and the butt-end of the implement forming a smooth, generally rounded profile.

10. A sports handle grip as set forth in claim 9, in which the first concentric gripping ridge is located at from about 0.2 to about 0.4 of the length X of the longitudinal axis of the handle, and the second gripping ridge is located at about 0.5 to about 0.75 of the length X along the longitudinal axis.

11. A sports handle grip as set forth in claim 10, in which the handle further includes flattened grip areas on at least the first and second gripping valleys.

12. A sports handle grip as set forth in claim 11, in which said flattened grip areas comprise ovals with the longitudinal axis running in the direction of the longitudinal axis of the handle, and wherein there are about 4 to about 8 ovals about the circumference of each valley.

* * * * *